US011105006B2

(12) United States Patent
Fujinuma

(10) Patent No.: US 11,105,006 B2
(45) Date of Patent: Aug. 31, 2021

(54) CARBON DIOXIDE REDUCTION APPARATUS AND METHOD OF PRODUCING ORGANIC COMPOUND

(71) Applicant: SEKISUI CHEMICAL CO., LTD., Osaka (JP)

(72) Inventor: Naohiro Fujinuma, Glassboro, NJ (US)

(73) Assignee: SEKISUI CHEMICAL CO., LTD., Osaka (JP)

( * ) Notice: Subject to any disclaimer, the term of this patent is extended or adjusted under 35 U.S.C. 154(b) by 353 days.

(21) Appl. No.: 15/928,366

(22) Filed: Mar. 22, 2018

(65) Prior Publication Data

US 2019/0292668 A1 Sep. 26, 2019

(51) Int. Cl.
*C25B 15/00* (2006.01)
*C25B 9/19* (2021.01)
(Continued)

(52) U.S. Cl.
CPC ..... *C25B 9/19* (2021.01); *C25B 1/00* (2013.01); *C25B 3/23* (2021.01); *C25B 3/25* (2021.01); *C25B 9/23* (2021.01); *C25B 15/08* (2013.01)

(58) Field of Classification Search
CPC .. C25B 15/08; C25B 9/00; C25B 9/06; C25B 9/08; C25B 9/10; C25B 1/10
See application file for complete search history.

(56) References Cited

U.S. PATENT DOCUMENTS

2009/0014336 A1 1/2009 Olah et al.
2011/0083968 A1* 4/2011 Gilliam ..... C25B 9/00 205/555
(Continued)

FOREIGN PATENT DOCUMENTS

JP 2003-213472 7/2003
JP 5017499 9/2012
(Continued)

OTHER PUBLICATIONS

Qi Lu et al., "Electrochemical $CO_2$ reduction: Electrocatalyst, reaction mechanism, and process engineering", Nano Energy 29 (2016) pp. 436-456.
(Continued)

*Primary Examiner* — Zulmariam Mendez
(74) *Attorney, Agent, or Firm* — Wenderoth, Lind & Ponack, L.L.P.

(57) ABSTRACT

A carbon dioxide reduction apparatus comprises a first electrochemical compartment provided with a first electrode, a second electrochemical compartment provided with a second electrode, an ion conducting membrane which demarcates the first electrochemical compartment from the second electrochemical compartment, and a first connecting path which connects the first electrochemical compartment with the second electrochemical compartment. The first electrode contains a first catalyst which catalyzes a reduction of carbon dioxide to a reduced product, and the second electrode contains a second catalyst which catalyzes a reaction between the reduced product and a reactant. The first connecting path is a connecting path which allows the reduced product in the first electrochemical compartment to flow out to the second electrochemical compartment.

14 Claims, 4 Drawing Sheets

(51) Int. Cl.

| | |
|---|---|
| ***C25B 15/08*** | (2006.01) |
| ***C25B 1/00*** | (2021.01) |
| ***C25B 3/23*** | (2021.01) |
| ***C25B 3/25*** | (2021.01) |
| ***C25B 9/23*** | (2021.01) |

(56) References Cited

U.S. PATENT DOCUMENTS

| | | | | |
|---|---|---|---|---|
| 2012/0132537 | A1 | 5/2012 | Sivasankar et al. | |
| 2013/0118910 | A1* | 5/2013 | Teamey | C07C 51/15 205/427 |
| 2017/0073827 | A1 | 3/2017 | Tamura et al. | |
| 2018/0179649 | A1* | 6/2018 | Fleischer | C25B 9/06 |
| 2019/0085477 | A1* | 3/2019 | Ono | C25B 1/12 |

FOREIGN PATENT DOCUMENTS

| | | |
|---|---|---|
| JP | 5376381 | 12/2013 |
| WO | 2012/077198 | 6/2012 |

OTHER PUBLICATIONS

Akiyasu Funakawa et al., "High Efficient Electrochemical Carbonylation of Methanol to Dimethyl Carbonate by $Br_2$/Br Mediator System over Pd/C Anode", Journal of the Electrochemical Society, 153(4), D68-D73 (2006).

Ryoichi Kanega et al., "Electrosynthesis of diphenyl carbonate by homogeneous Pd electrocatalysts using Au nanoparticles on graphene as efficient anodes", Catalysis Science & Technology, 2016, 6, pp. 6002-6010.

International Search Report and Written Opinion of the International Searching Authority dated Jul. 16, 2019, in International (PCT) Application No. PCT/JP2019/013912.

* cited by examiner

CARBON DIOXIDE REDUCTION APPARATUS AND METHOD OF PRODUCING ORGANIC COMPOUND

TECHNICAL FIELD

The present invention relates to a carbon dioxide reduction apparatus and a method of producing an organic compound.

BACKGROUND ART

A carbon dioxide reduction apparatus which electrically reduces carbon dioxide to produce valuable chemicals has attracted attention as a method for decreasing the amount of carbon dioxide emission and storing natural energy, and has been researched and developed (Non-Patent Literature 1). In a conventional carbon dioxide reduction apparatus, carbon dioxide is reduced on a first electrode (cathode) side; and metals, alloys, metal carbon compounds, carbon compounds and the like have been reported, as catalysts for high efficient reductions (Patent Literatures 1 to 3). In the carbon dioxide reduction apparatuses reported in each of the above literatures, efforts have been made on development of only the reaction on the first electrode (cathode), and conventionally, there have been few development examples in which attention has been paid to the second electrode (anode) in the same apparatus.

On the other hand, several organic compound oxidizing apparatuses which oxidize organic compounds to produce valuable chemicals have also been reported (for instance, Patent Literature 4, and Non-Patent Literatures 2 and 3). In organic compound oxidizing apparatuses which are reported in the literatures, efforts have been made on development of the second electrode where an oxidation reaction occurs, and conventionally, little attention has been paid to the first electrode (cathode).

CITATION LIST

Patent Literature

PTL 1: JP 5376381 B
PTL 2: JP 2003-213472 A
PTL 3: JP 5017499 B
PTL 4: WO 2012-077198

Non-Patent Literature

NPL 1: Nano Energy 29 (2016) 439-456
NPL 2: Journal of the Electrochemical Society, 153(4), D68 (2006)
NPL 3: Catal. Sci. Technol. 2016, 6, 6002-6010

SUMMARY OF INVENTION

As has been described above in each of the above described apparatuses, conventionally attention is often paid to any one of the reaction on the first electrode and the reaction on the second electrode, and the reaction on an electrode in the other side is not effectively utilized in many cases. For instance, in the carbon dioxide reduction apparatus, an oxidation reaction of water is carried out on the second electrode in many cases, but oxygen which is the product by the oxidation reaction is not industrially valuable, and electrical energy required for the reaction on the second electrode of the carbon dioxide reduction apparatus results in being lost.

Thus, an object of the present invention is to provide a carbon dioxide reduction apparatus that can effectively utilize electrical energy by combining a reaction occurring on a first electrode (cathode) with a reaction occurring on a second electrode (anode); and a method of producing an organic compound using the carbon dioxide reduction apparatus.

The present inventor has made an extensive investigation, as a result, has found that the above described object can be achieved by a carbon dioxide reduction apparatus having a specific configuration, and have completed the following present invention. Specifically, the present invention provides the following [1] to [7].

[1] A carbon dioxide reduction apparatus comprising: a first electrochemical compartment provided with a first electrode; a second electrochemical compartment provided with a second electrode; an ion conducting membrane which demarcates the first electrochemical compartment from the second electrochemical compartment; and a first connecting path which connects the first electrochemical compartment with the second electrochemical compartment, wherein the first electrode contains a first catalyst which catalyzes a reduction of carbon dioxide to a reduced product, the second electrode contains a second catalyst which catalyzes a reaction between the reduced product and a reactant, and the first connecting path is a connecting path which allows the reduced product in the first electrochemical compartment to flow out to the second electrochemical compartment.

[2] The carbon dioxide reduction apparatus according to [1] further comprising a second connecting path which connects the first electrochemical compartment with the second electrochemical compartment, wherein the second connecting path is a connecting path which allows carbon dioxide in the second electrochemical compartment to flow into the first electrochemical compartment.

[3] The carbon dioxide reduction apparatus according to [1] or [2], wherein the second catalyst contains one or more elements of Groups 8 to 12.

[4] The carbon dioxide reduction apparatus according to any one of [1] to [3], wherein the second electrochemical compartment contains a third catalyst which catalyzes a reaction between the reduced product and the reactant.

[5] The carbon dioxide reduction apparatus according to [4], wherein the third catalyst is a redox catalyst.

[6] The carbon dioxide reduction apparatus according to any one of [1] to [5], wherein the reduced product is carbon monoxide, and the reactant contains at least any one compound represented by the following general formulae (1) to (2):

$$R^1OH \quad (1)$$

wherein $R^1$ represents an organic group having 1 to 15 carbon atoms, or a hydrogen atom; and $$R^2NH_2 \quad (2)$$

wherein $R^2$ represents an organic group having 1 to 15 carbon atoms, or a hydrogen atom.

[7] A method of producing an organic compound by using the carbon dioxide reduction apparatus according to any one of [1] to [6].

DESCRIPTION OF EMBODIMENTS

Figure 1:
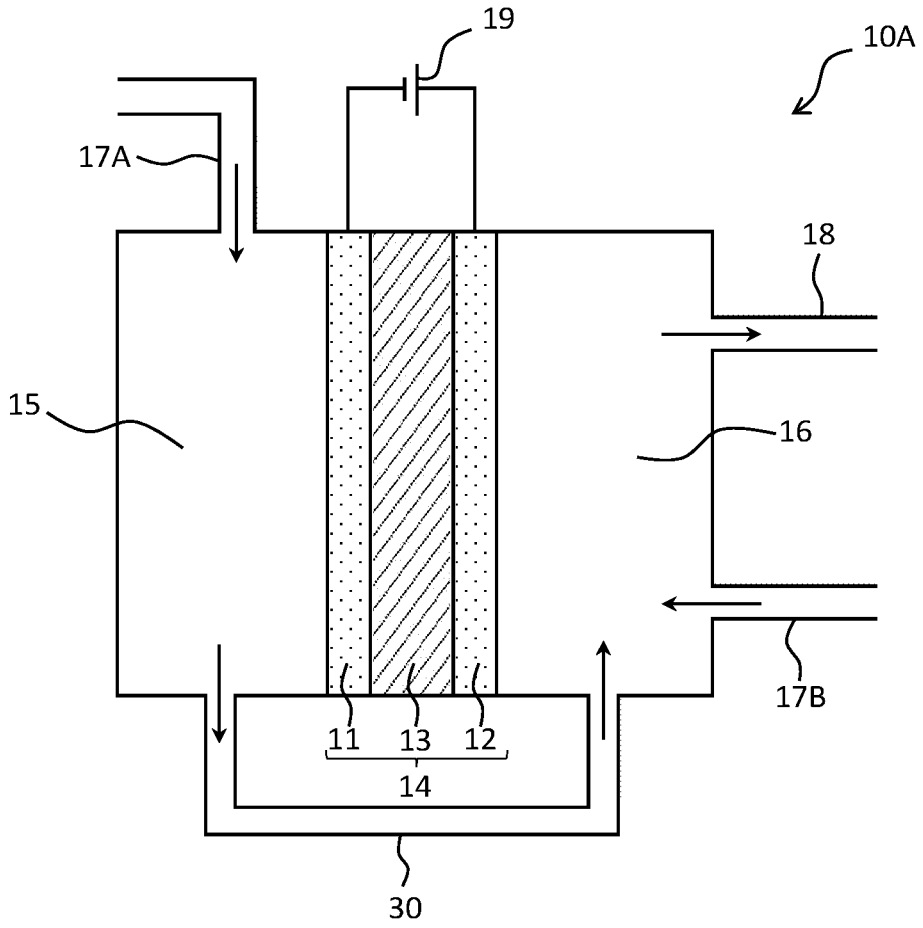
FIG. 1 is a schematic diagram showing one embodiment of a carbon dioxide reduction apparatus of the present invention.

The carbon dioxide reduction apparatus of the present invention will be described in more detail below.

The carbon dioxide reduction apparatus of the present invention comprises a first electrochemical compartment provided with a first electrode, a second electrochemical compartment provided with a second electrode, an ion conducting membrane which demarcates the first electrochemical compartment from the second electrochemical compartment, and a first connecting path which connects the first electrochemical compartment with the second electrochemical compartment.

The first electrode contains a first catalyst which catalyzes a reduction carbon dioxide to a reduced product. In addition, the second electrode contains a second catalyst which catalyzes a reaction between the above described reduced product and a reactant. The first connecting path is a connecting path which allows the reduced product in the first electrochemical compartment to flow out to the second electrochemical compartment.

Incidentally, in the carbon dioxide reduction apparatus of the present invention, the first electrode is a cathode and the second electrode is an anode.

In the carbon dioxide reduction apparatus of the present invention, firstly, carbon dioxide is made to flow into the first electrochemical compartment, and the carbon dioxide which has flowed therein is reduced on the first electrode (hereinafter referred to also as "first reaction") to form a reduced product of the carbon dioxide. The reduced product is made to flow out from the first electrochemical compartment to the second electrochemical compartment through the first connecting path.

On the other hand, on the second electrode of the second electrochemical compartment, the reactant in the second electrochemical compartment reacts with the reduced product which has flowed therein from the first electrochemical compartment (hereinafter referred to also as "second reaction"), and valuable chemicals such as an organic compound (hereinafter also referred to as "final product") are synthesized. In addition, on the second electrode, a cation such as proton is generated by the second reaction, and the cation is sent to the first electrode through the ion conducting membrane, the electrolyte solution, or both of them, and is subjected to the first reaction.

As has been described above, the carbon dioxide reduction apparatus of the present invention combines the reaction on the first electrode with the reaction on the second electrode, and can utilize the electrical energy of the second electrode side, which has not been conventionally effectively utilized, for the synthesis of an industrially useful substance.

In addition, the carbon dioxide reduction apparatus of the present invention can eliminate the subsequent chemical process such as a carbonylation reaction, which has been needed for producing a useful substance in the conventional carbon dioxide reduction apparatus.

In a more preferred embodiment of the carbon dioxide reduction apparatus of the present invention, the first electrochemical compartment and the second electrochemical compartment are further connected by a second connecting path. The second connecting path is a connecting path which allows the carbon dioxide in the second electrochemical compartment to flow into the first electrochemical compartment.

Specifically, when the carbon dioxide reduction apparatus of the present invention has the second connecting path, the carbon dioxide circulates in a circuit of the first electrochemical compartment, the first connecting path, the second electrochemical compartment, the second connecting path and the first electrochemical compartment, and is subjected to the first reaction in a course of the circulation, and accordingly, a conversion rate of the carbon dioxide in the whole carbon dioxide reduction apparatus can be enhanced.

The examples of the reduced product of the carbon dioxide, which is formed on the first electrode of the carbon dioxide reduction apparatus of the present invention, include CO (carbon monoxide), $HCO_3^-$, $OH^-$, $HCO^-$, $H_2CO$, $(HCO_2)^-$, $H_2CO_2$, $CH_3OH$, $CH_4$, $C_2H_4$, $CH_3CH_2OH$, $CH_3COO^-$, $CH_3COOH$, $C_2H_6$, $O_2$, $(COOH)_2$ and $(COO^-)_2$, but it is preferably carbon monoxide. Incidentally, the first reaction in the case where the carbon monoxide is generated is represented by the following formula (i).

$$CO_2+2H^++2e^-\rightarrow CO+H_2O \quad \text{(i)}$$

Next, embodiments of the carbon dioxide reduction apparatus of the present invention will be described in more detail with reference to the drawings. Incidentally, in the following description of the embodiments of the carbon dioxide reduction apparatus of the present invention, an example will be described in which carbon monoxide is used as a reduced product, but the carbon dioxide reduction apparatus of the present invention is not limited to this configuration.

First Embodiment

FIG. 1 is a schematic view of a carbon dioxide reduction apparatus 10A according to a first embodiment of the present invention. Incidentally, in each drawing, each arrow indicates a movement direction of the raw material and the product in the carbon dioxide reduction apparatus 10A.

The carbon dioxide reduction apparatus 10A has a first electrode 11, a second electrode 12 and an ion conducting membrane 13 provided inside a cell. The first electrode 11 and the second electrode 12 are arranged on both sides of the ion conducting membrane 13, respectively, and are bonded thereto so as to form a membrane-electrode assembly 14.

In the carbon dioxide reduction apparatus 10A, the cell is demarcated by the membrane-electrode assembly 14, so that a first electrochemical compartment 15 and a second electrochemical compartment 16 are formed. Thereby, the carbon dioxide reduction apparatus 10A has a two chamber type cell-structure in which the cell is separated into two chambers by the membrane-electrode assembly 14, and the first electrode 11 is provided on the inner surface of the first electrochemical compartment 15, and the second electrode 12 is provided on the inner surface of the second electrochemical compartment 16. A power source 19 is connected to the first electrode 11 and the second electrode 12, and a voltage is applied between the first electrode 11 and the second electrode 12, by the power source 19.

<First Electrochemical Compartment>

A first inlet port 17A is connected to the first electrochemical compartment 15, and carbon dioxide is made to flow therein through the first inlet port 17A. Carbon dioxide is made to flow therein as a gas. The first inlet port 17A is connected to a carbon dioxide supplier (not shown) or the like, and the carbon dioxide is made to flow therein from the carbon dioxide supplier or the like.

The first inlet port 17A may have an arbitrary mechanism such as a flow rate adjusting mechanism, and the flow rate and the like of the carbon dioxide to flow therein may be adjusted. Carbon dioxide is continuously made to flow into the first electrochemical compartment 15.

In the present embodiment, the first electrochemical compartment 15 is not filled with a solvent such as water and an electrolyte solution, and gaseous carbon dioxide is brought into contact with the first electrode 11. However, the gaseous carbon dioxide may contain moisture.

Incidentally, carbon dioxide may be made to flow into the first electrochemical compartment 15 alone, or may be made to flow into the first electrochemical compartment 15 together with an inert gas such as helium, which works as a carrier gas, but is preferably made to flow therein in a form of carbon dioxide alone.

(First Electrode)

The carbon dioxide having flowed into the first electrochemical compartment 15 is reduced to carbon monoxide on the first electrode 11. The first electrode 11 contains a first catalyst (hereinafter also referred to as "reduction catalyst") which reduces the carbon dioxide into a reduced product. As the reduction catalyst, various metals or metal compounds, or carbon compounds containing at least one of hetero elements and metals can be used for example.

The above described metals include V, Cr, Mn, Fe, Co, Ni, Cu, Sn, Zr, Nb, Mo, Ru, Rh, Pd, Ag, Cd, Hf, Ta, W, Re, Ir, Pt, Au, Hg, Al, Si, In, Sn, Tl, Pb, Bi, Sb, Te, U, Sm, Tb, La, Ce and Nd. Among the metals, preferred specific examples of the metal elements include Sb, Bi, Sn, Pb, Ni, Ru, Co, Rh, Cu and Ag, and among the above elements, Bi, Sb, Ni, Co, Ru and Ag are more preferable.

Metal compounds such as inorganic metal compounds and organic metal compounds of the above metals can be used as the above described metal compounds, and specific examples thereof include a metal halide, a metal oxide, a metal hydroxide, a metal nitrate, a metal sulfate salt, a metal acetate, a metal phosphate, a metal carbonyl and a metal acetylacetonate.

The carbon compounds containing at least one of hetero elements and metals include: nitrogen-containing graphite, nitrogen-containing carbon nanotube, nitrogen-containing graphene, graphite containing Ni and nitrogen, carbon nanotube containing Ni and nitrogen, graphene containing Ni and nitrogen, graphite containing Cu and nitrogen, carbon nanotube containing Cu and nitrogen, graphene containing Cu and nitrogen, graphite containing Co and nitrogen, carbon nanotube containing Co and nitrogen, and graphene containing Co and nitrogen.

It is preferable that the first electrode contains an electroconductive carbon material for imparting electroconductivity thereto, in addition to the above described reduction catalyst. However, when the above described carbon compound is used as the reduction catalyst, the carbon compound also functions as the electroconductive carbon material. Various carbon materials having electrical conductivity can be used as the electroconductive carbon material, and the examples thereof include carbon black such as activated carbon, Ketchen black and acetylene black, graphite, carbon fiber, carbon paper and carbon whisker.

It is preferable that the first electrode is an electrode in which at least one of the above described metals and metal compounds is supported by the electroconductive carbon material such as carbon paper. The supporting method is not limited, but for instance the metal or metal compound, which is dispersed in a solvent, may be applied onto the electroconductive carbon material such as the carbon paper, and then heated.

A fluorine-containing compound such as polytetrafluoroethylene (PTFE), tetrafluoroethylene oligomer (TFEO), graphite fluoride ((CF)n) and fluorinated pitch (FP) may be blended in the first electrode. These compounds are used as a water-repellent agent, and improve electrochemical reaction efficiency. The above described fluorine-containing compound can also be used as a binder when the first electrode is formed. In this case, the first electrode may be prepared by dispersing the above described reduction catalyst and the above described fluorine compound in a solvent, applying the solvent onto the electroconductive carbon material such as the carbon paper, and heating the electroconductive carbon material.

<First Connecting Path>

The first connecting path 30 connects the first electrochemical compartment 15 with the second electrochemical compartment 16, and allows the carbon monoxide which has been generated in the first electrochemical compartment 15 to flow out to the second electrochemical compartment 16. The first connecting path 30 is, for instance, a conducting pipe or the like which connects the first electrochemical compartment 15 with the second electrochemical compartment 16, and it may have a flow rate adjusting mechanism or the like provided so as to adjust a flow rate and the like. In addition, a non-return valve or the like may be attached to the conducting pipe, so that the gas is sent from the first electrochemical compartment 15 to the second electrochemical compartment 16 through the first connecting path 30 but the gas is not sent in the reverse direction.

The carbon monoxide generated in the first electrochemical compartment 15 is made to flow into the second electrochemical compartment 16 through the first connecting path 30 as the gas, for instance, together with carbon dioxide which has not reacted in the first electrochemical compartment 15.

Incidentally, in the first electrochemical compartment 15 which is not filled with a liquid such as an electrolyte solution, the generated carbon monoxide is sequentially mixed with unreacted carbon dioxide in a gas phase, passes through the first connecting path 30 as it is, and is made to flow out to the second electrochemical compartment 16. In addition, the water which is generated as a by-product remains in the electrochemical compartment, and is discharged when the amount of the water reaches a certain amount. The first electrochemical compartment 15 may be provided with a discharge port for discharging the water which is a by-product.

<Second Electrochemical Compartment>

The inside of the second electrochemical compartment 16 is filled with a reactant. The reactant may be previously introduced into the inside of the second electrochemical compartment 16 through a second inlet port 17B which is connected to the second electrochemical compartment 16. The reactant may be in any of a solid, liquid and gas state, but is preferably the gas or liquid state. In the case where the reactant is in the solid or gas state, or in the case where it is necessary to improve the solubility of a third catalyst or the like which will be described later, the reactant may be filled in the second electrochemical compartment 16 as a liquid mixture with a solvent (hereinafter also simply referred to as "liquid mixture"). Incidentally, the inside of the second electrochemical compartment 16 may be fully filled with the reactant or the liquid mixture, or a part thereof may be an empty space.

The solvent which may be used together with the reactant can be selected from solvents which are usually used for an electrochemical reaction, and the examples thereof include nitrile-based solvents such as acetonitrile; carbonic ester-based solvents such as ethylene carbonate, propylene carbonate, butylene carbonate, vinylene carbonate, dimethyl carbonate, ethylmethyl carbonate and diethyl carbonate; lactone-based solvents such as γ-butyrolactone; ether-based solvents such as 1,2-dimethoxyethane, 1-ethoxy-2-methoxyethane, 1,2-diethoxyethane, tetrahydrofuran and 2-methyltetrahydrofuran; phosphoric acid ester solvents; phosphoric acids; sulfolane-based solvents and pyrrolidones. These solvents may be used each alone, or two or more of these solvents may be used in combination.

It is preferable that an electrolyte salt is added to a liquid reactant or a liquid mixture, from the viewpoint of improving electrochemical reaction efficiency. In this case, the reactant or the liquid mixture itself functions as the electrolyte solution.

The electrolyte salts include an alkali metal salt, a peroxide of an alkali metal and an ammonium salt.

Specifically, examples of the alkali metal salts include: lithium salts such as lithium hydroxide, lithium chloride, lithium bromide, lithium iodide, lithium hydrogen carbonate, lithium sulfate, lithium hydrogen sulfate, lithium phosphate and lithium hydrogen phosphate; sodium salts such as sodium hydroxide, sodium chloride, sodium bromide, sodium iodide, sodium hydrogen carbonate, sodium sulfate, sodium hydrogen sulfate, sodium phosphate and sodium hydrogen phosphate; and potassium salts such as potassium hydroxide, potassium chloride, potassium bromide, potassium iodide, potassium hydrogen carbonate, potassium sulfate, potassium hydrogen sulfate, potassium phosphate and potassium hydrogen phosphate.

The examples of the peroxides of the alkali metals include lithium peroxide and sodium peroxide.

The examples of the ammonium salts include ammonium chloride, ammonium bromide, ammonium iodide, ammonium perchlorate, and tetrabutylammonium tetrafluoroborate.

These electrolyte salts may be used each alone, or two or more of the salts may be used in combination.

The concentration of the electrolyte salt in the solution is, for instance, in a range of 0.001 to 2 mol/L, and preferably is in a range of 0.01 to 1 mol/L.

Carbon monoxide generated in the first electrochemical compartment 15 is made to flow into the second electrochemical compartment 16 through the first connecting path 30. It is preferable that the carbon monoxide is made to flow into the second electrochemical compartment 16 by a method of bubbling or the like. The bubbled carbon monoxide is subjected to a second reaction with the reactant. Here, at least a part of the carbon monoxide is dissolved in the reactant or the liquid mixture which is filled in the second electrochemical compartment 16, and is reacted with the reactant on the second electrode 12 and the like.

(Reactant)

The reactant in the present invention reacts with the carbon monoxide in the second electrochemical compartment 16 to produce valuable chemicals such as an organic compound. The reactant may be appropriately selected according to a target final product, but an alcohol compound, an amine compound and the like are preferable, from the viewpoint of reactivity with the carbon monoxide and the like. The alcohol compounds include a monoalcohol compound and a glycol compound, and the amine compounds include a monoamine compound and a diamine compound. More specifically, the reactant preferably includes at least any one of compounds represented by the following general formulae (1) to (2):

$$R^1OH \quad (1)$$

wherein $R^1$ represents an organic group having 1 to 15 carbon atoms, or a hydrogen atom; and $$R^2NH_2 \quad (2)$$

wherein $R^2$ represents an organic group having 1 to 15 carbon atoms, or a hydrogen atom.

In the case where the above described reduced product is the carbon monoxide and the above described reactant is a compound represented by the general formula (1), a carbonylation reaction preferably occurs as in the following formula (ii), on the second electrode 12.

$$CO+2R^1OH \rightarrow (R^1O)_2CO+2H^++2e^- \quad (ii)$$

In addition, in the case where the above described reduced product is the carbon monoxide and the above described reactant is a compound represented by the general formula (2), a urea reaction preferably occurs as in the following formula (iii), on the second electrode 12.

$$CO+2R^2NH_2 \rightarrow (R^2NH)_2CO+2H^++2e^- \quad (iii)$$

The organic groups each having 1 to 15 carbon atoms represented by $R^1$ in the above described general formula (1) include a hydrocarbon group having 1 to 15 carbon atoms. The hydrocarbon group is preferably an alkyl group or an alkenyl group having 1 to 15 carbon atoms, or an aryl group having 6 to 15 carbon atoms.

The alkyl groups each having 1 to 15 carbon atoms include a methyl group, an ethyl group, various propyl groups, various butyl groups, various pentyl groups, various hexyl groups, various heptyl groups, various octyl groups, various nonyl groups, various decyl groups, various dodecyl group and various pentadecyl groups.

The alkenyl groups each having 1 to 15 carbon atoms include a vinyl group, various propynyl groups, various butynyl groups, various pentynyl groups, various hexenyl groups, various heptenyl groups, various octenyl groups, various nonenyl groups, various decenyl groups, various dodecenyl groups and various pentadecenyl groups.

Incidentally, "various" means various isomers including n-, sec-, tert- and iso-. In addition, the alkyl group or the alkenyl group may be any one of linear, branched and cyclic groups.

The aryl groups each having 6 to 15 carbon atoms include a phenyl group and a naphthyl group.

Incidentally, the above described hydrocarbon groups may have a substituent, and in that case, the number of carbon atoms including those in the substituent is 1 to 15.

In addition, the organic group having 1 to 15 carbon atoms in the general formula (1) may contain a hetero atom such as a nitrogen atom, an oxygen atom, a sulfur atom and a phosphorus atom.

Among the atoms, the oxygen atom is preferable. When the organic group has the oxygen atom, the oxygen atom is preferably an oxygen atom of any one of an alcohol group and an ether bond. Accordingly, $R^1$ is preferably a hydrocarbon group having at least one of the alcohol group and the ether bond. In addition, it is preferable that only one alcohol group exists in $R^1$.

More specifically, $R^1$ having the oxygen atom is preferably a hydroxyalkyl group having 2 to 15 carbon atoms, or a group represented by the following formula (3).

$$H—(OR)_m— \quad (3)$$

Incidentally, in the formula (3), R is a divalent saturated hydrocarbon group having 2 to 4 carbon atoms, and m is an integer of 2 to 7. In the formula (3), the OR includes an oxyethylene group, an oxypropylene group and an oxybutylene group.

The organic groups each having 1 to 15 carbon atoms represented by $R^2$ in the above described general formula (2) include a hydrocarbon group having 1 to 15 carbon atoms, and the specific description is similar to that for the above described hydrocarbon group in $R^1$.

In addition, the organic group having 1 to 15 carbon atoms in the general formula (2) may contain a hetero atom such as a nitrogen atom, an oxygen atom, a sulfur atom and a phosphorus atom. Among the atoms, the nitrogen atom is preferable, and the nitrogen atom is preferably a nitrogen atom of an amino group. Accordingly, $R^2$ is preferably a hydrocarbon group having an amino group. More specifically, an aminoalkyl group having 1 to 15 carbon atoms is preferable.

As for the compounds represented by the above described general formula (1), among the above described compounds, such compounds are more preferable that $R^1$ is an alkyl group or an alkenyl group having 1 to 8 carbon atoms, an aryl group having 6 to 8 carbon atoms, or a hydroxyalkyl group having 2 to 8 carbon atoms; and specifically, methanol, ethanol, phenol, 1-propanol, 1-butanol, ethylene glycol, propylene glycol and the like are preferable. Among these compounds, such compounds are particularly preferable that $R^1$ is the alkyl group or the aryl group.

As for the compounds represented by the above described general formula (2), among the above described compounds, such compounds are more preferable that $R^2$ is an alkyl group or alkenyl group having 1 to 8 carbon atoms, or an aryl group having 6 to 8 carbon atoms; and specifically, butylamine, pentylamine, aniline, cyclopentylamine, cyclohexylamine and the like are preferable. Among these compounds, such compounds are particularly preferable that $R^2$ is an alkyl group or an aryl group.

Incidentally, the reactants may be used each alone, or two or more of the reactants may be used in combination.

(Second Electrode)

The second electrode 12 contains a second catalyst which electrically catalyzes a reaction between carbon monoxide and the reactant. The material which can be used as the second catalyst contains one, two or more selected from the group consisting of various metals, metal compounds and electroconductive carbon materials, for instance.

The second catalyst preferably contains one or more elements of Groups 8 to 12 as a metal, and examples of the elements include iron, gold, copper, nickel, platinum, palladium, ruthenium, osmium, cobalt, rhodium and iridium. Metal compounds such as inorganic metal compounds and organic metal compounds of the above metals can be used as the metal compound; specific examples of the compounds include a metal halide, a metal oxide, a metal hydroxide, a metal nitrate, a metal sulfate, a metal acetate, a metal phosphate, a metal carbonyl and a metal acetylacetonate; and the metal halide is preferable.

As the electroconductive carbon material, various carbon materials having electrical conductivity can be used, and the examples thereof include carbon black such as mesoporous carbon, activated carbon, Ketchen black and acetylene black, graphite, carbon fiber, carbon paper and carbon whisker.

The second electrode 12 is a composite material which is formed by mixing at least any of a metal and a metal compound with an electroconductive carbon material. The composite material includes a composite film. The composite film can be formed by dispersing a mixture of at least one of the metal and the metal compound, and the electroconductive carbon material into the solvent; applying the resultant dispersion onto a substrate or the like; and heating the substrate or the like. At this time, an electroconductive carbon material such as carbon paper may be used as the substrate.

A fluorine-containing compound such as polytetrafluoroethylene (PTFE), tetrafluoroethylene oligomer (TFEO), graphite fluoride ((CF)n) and fluorinated pitch (FP) may be blended in the second electrode 12. These compounds are used as a water-repellent agent, and improve electrochemical reaction efficiency.

In addition, the above described fluorine-containing compound can be also used as a binder when the second electrode is formed. Accordingly, when the above described composite material is formed, the fluorine-containing compound may be further mixed with at least one of the metal and the metal compound, and the electroconductive carbon material.

(Third Catalyst)

The carbon dioxide apparatus of the present invention may contain a third catalyst in the second electrochemical compartment, which catalyzes a reaction (second reaction) between the reduced product of carbon dioxide and the reactant. It is preferable that the third catalyst is contained in the reactant or the liquid mixture of the reactant and the solvent, which is filled in the second electrochemical compartment. The third catalyst may be contained in the second electrode of the second electrochemical compartment, by being supported by the second electrode, or by the like.

The third catalyst is preferably a redox catalyst. Incidentally, the redox catalyst in the present specification may be a compound of which the oxidation state can reversibly change, and the examples include a metal compound containing at least an active metal, an organic compound and a halogen. The redox catalyst exhibits oxidation-reduction characteristics, and accordingly catalyzes the second reaction between the carbon monoxide and the reactant in a region other than the vicinity of the second electrode and the redox catalyst itself is reduced. The reduced redox catalyst is oxidized again by an electrochemical reaction on the second electrode, and thereby can catalyze the second reaction between the carbon monoxide and the reactant again.

The reactant filled in the second electrochemical compartment generally reacts with the carbon monoxide which exists in the reactant or in the liquid mixture of the reactant and the solvent, on the second electrode (second reaction). Here, as for the second reaction, when the volume of the reactant is large, the diffusion of the reactant in the vicinity of the second electrode ordinarily becomes a rate-determining step of the second reaction, and the overall reaction rate becomes slow. However, when the redox catalyst is contained, the material which diffuses on the second electrode becomes only the redox catalyst, and accordingly a reaction rate of the second reaction in the second electrochemical compartment 16 can be improved. In addition, restrictions on the physical properties of the reactant are relaxed, and accordingly, it becomes possible to use various reactants. Furthermore, the variation of the reaction is expanded, and it becomes possible to control the reaction in the second electrochemical compartment 16 to an aminocarbonylation reaction, an alkoxycarbonylation reaction, a carbonylation coupling reaction and the like.

The active metals contained in the redox catalyst include V, Cr, Mn, Fe, Co, Ni, Cu, Sn, Zr, Nb, Mo, Ru, Rh, Pd, Ag, Cd, Hf, Ta, W, Re, Ir, Pt, Au, Hg, Al, Si, In, Sn, Tl, Pb, Bi, Sb, Te, U, Sm, Tb, La, Ce and Nd. Among the metals, Pd, Co and Ni are preferable.

As the metal compound containing at least the active metal, inorganic metal compounds and organic metal compounds of the above metals can be used, and the examples thereof include a metal halide, a metal oxide, a metal hydroxide, a metal nitrate, a metal sulfate, a metal acetate, a metal phosphate, a metal carbonyl, and metal organic complexes such as a metal acetylacetonate.

Specific examples of the metal compound containing the active metal include palladium acetylacetonate ($Pd(OAc)_2$), tetrakis(triphenylphosphine)palladium ($Pd(PPh_3)_4$ complex), tris(2,2'-bipyridine)cobalt ($Co(bpy)_3$ complex), and tris[1,3-bis(4-pyridyl)propane)]cobalt ($Co(bpp)_3$ complex).

The organic compounds which are used in the redox catalyst include 2,2,6,6-tetramethylpiperidine 1-oxyl (TEMPO).

The halogens which are used in the redox catalyst include bromine and iodine.

The third catalysts may be used each alone, or two or more of the catalysts may be used in combination.

The concentration of the third catalyst in the solution filled in the second electrochemical compartment is, for instance, in a range of 0.001 to 2 mol/L, and preferably is in a range of 0.001 to 1 mol/L.

The final product generated by the above described second reaction may be discharged from the discharge port 18. Usually an unreacted reactant, a solvent and the like are also discharged from the discharge port 18, together with the final product. The discharge of the final product from the discharge port 18 is not limited in particular, but may be conducted after a certain amount of the final product has been produced in the inside of the second electrochemical compartment 16 for instance. The final product which has been discharged from the discharge port 18 may be appropriately purified. The carbon dioxide reduction apparatus may have a refining mechanism for the purification. In addition, the unreacted reactant, the solvent and the like which have been discharged together with the final product may be introduced again from the second inlet port 17B. The carbon dioxide reduction apparatus of the present embodiment may have a reactant separation mechanism, a reactant circulation mechanism and the like for the introduction.

<Ion Conducting Membrane>

A solid membrane can be used as the ion conducting membrane 13, and the examples include a cation conducting membrane which can transport a cation such as a proton, and an anion conducting membrane which can transport an anion. In the present embodiment, as has been described above, cations such as protons are generated in the second electrode 12, and the cations are sent to the first electrode 11 side through the ion conducting membrane 13.

Materials for the cation conducting membrane preferably include: hydrocarbon resin-based poly-sulfonic acids and carboxylic acids such as polyethylene sulfonic acid, fullerene cross-linked polysulfonic acid, and polyacrylic acid: and fluororesin-based sulfonic acids and carboxylic acids such as perfluoroethylene sulfonic acids. In addition, usable materials also include: phosphate glasses such as $SiO_2$—$P_2O_5$; heteropolyacids such as silicotungstic acid and phosphotungstic acid; and ceramics such as perovskite type oxides.

In addition, materials for the anion conducting membrane preferably include: resins having a quaternary ammonium salt such as poly(styrylmethyl(trimethyl)ammonium chloride); and polyethers.

Among the above described materials, the perfluoroethylene sulfonic acid resin is preferable among the materials for the cation conducting membrane. The commercially available product of the perfluoroethylene sulfonic acid resin includes Nafion (trademark of Du Pont).

Second Embodiment

Figure 2:
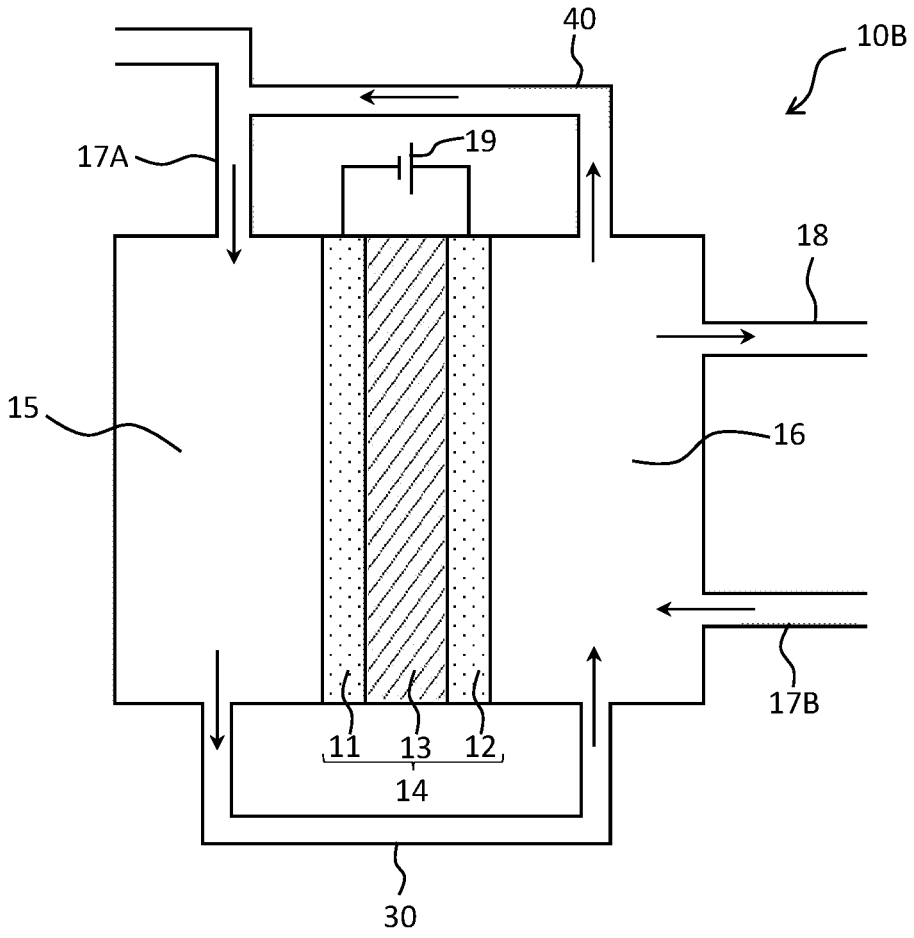
FIG. 2 is a schematic diagram showing another embodiment of the carbon dioxide reduction apparatus of the present invention.

Next, a carbon dioxide reduction apparatus according to a second embodiment of the present invention will be described. The carbon dioxide reduction apparatus of the second embodiment comprises a second connecting path. FIG. 2 shows a schematic view of a carbon dioxide reduction apparatus 10B according to the second embodiment of the present invention.

The carbon dioxide reduction apparatus 10B has a similar configuration to that of the carbon dioxide reduction apparatus 10A of the first embodiment, except that the carbon dioxide reduction apparatus 10B further comprises a second connecting path 40 which connects the first electrochemical compartment 15 with the second electrochemical compartment 16. Incidentally, among each configuration which the carbon dioxide reduction apparatus 10B of the present embodiment has, the members denoted by the same reference numerals as those of the carbon dioxide reduction apparatus 10A of the first embodiment have similar configurations to those of the carbon dioxide reduction apparatus 10A, unless otherwise described.

<Second Connecting Path>

The second connecting path 40 connects the first electrochemical compartment 15 with the second electrochemical compartment 16. The second connecting path 40 is, for instance, a conducting pipe which connects the first electrochemical compartment 15 with the second electrochemical compartment 16, and may have a flow rate adjusting mechanism or the like provided so as to adjust a flow rate and the like. In addition, a non-return valve or the like may be attached to the conducting pipe, so that the gas is sent from the second electrochemical compartment 16 to the first electrochemical compartment 15 but the gas is not sent in the reverse direction.

The second connecting path 40 is connected to the middle of the first inlet port 17A, so that the second connecting path 40 is connected to the first electrochemical compartment 15 through the first inlet port 17A, as shown in FIG. 2, but the second connecting path 40 may be connected directly to the first electrochemical compartment 15.

Due to the second connecting path 40 being provided, it becomes possible that the unreacted carbon dioxide which has passed through the first electrochemical compartment 15 and the first connecting path 30 and has been made to flow out to the second electrochemical compartment 16 further passes through the second electrochemical compartment 16 and the second connecting path 40, and flows into the first electrochemical compartment 15 again as a gas. In this way, the carbon dioxide circulates in a circuit of the first electrochemical compartment 15, the first connecting path 30, the second electrochemical compartment 16, the second connecting path 40 and the first electrochemical compartment 15, and is subjected to the first reaction in a course of the circulation, and accordingly, the second connecting path can enhance a conversion rate of the carbon dioxide in the whole carbon dioxide reduction apparatus.

Incidentally, the component which has passed through the second connecting path 40 and is made to flow into the first electrochemical compartment 15 may contain unreacted carbon monoxide which has not been subjected to the second reaction, among the carbon monoxide which has been generated in the first electrochemical compartment 15 and has been made to flow out to the second electrochemical compartment 16, in addition to the above described unreacted carbon dioxide. The carbon monoxide may circulate through the second electrochemical compartment 16, the second connecting path 40, the first electrochemical compartment 15, the first connecting path 30 and the second electrochemical compartment 16 in this order, and be subjected to the second reaction in a course of the circulation, in a similar way to the carbon dioxide. Thereby, a rate of conversion from the carbon monoxide to the final product increases.

Third Embodiment

Figure 3:
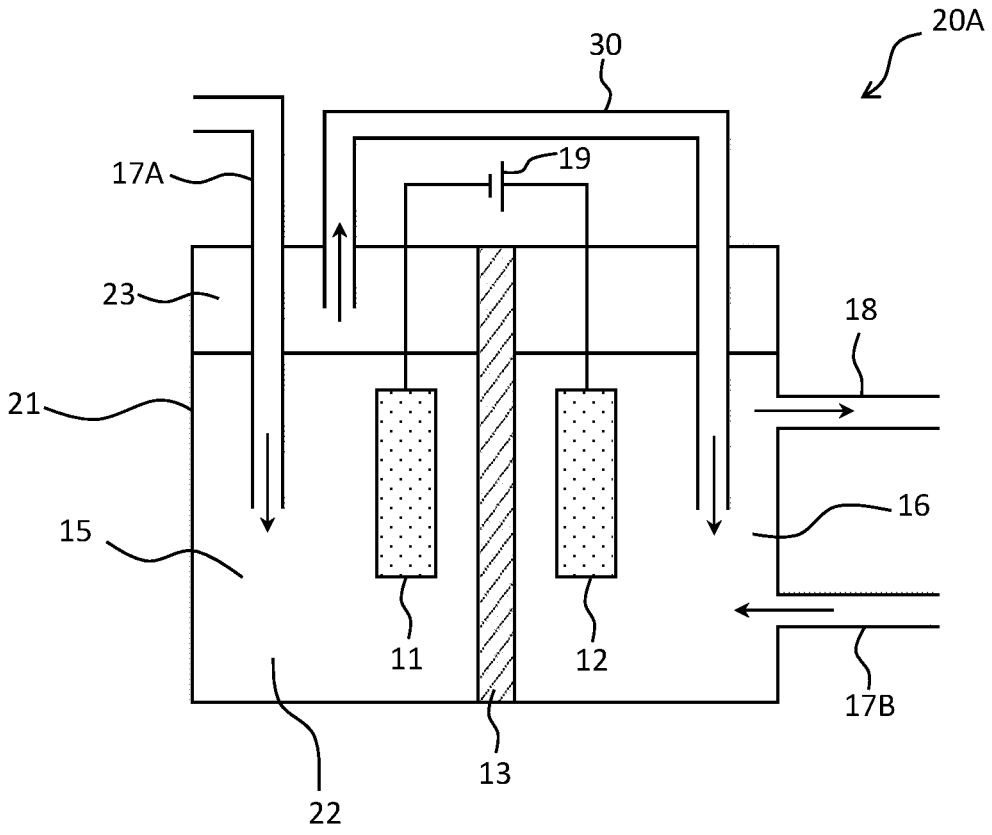
FIG. 3 is a schematic diagram showing another embodiment of the carbon dioxide reduction apparatus of the present invention.

Next, a carbon dioxide reduction apparatus according to a third embodiment of the present invention will be described. The third embodiment is a carbon dioxide reduction apparatus in which a first electrochemical compartment 15 is filled with an electrolyte solution. FIG. 3 shows a schematic view of a carbon dioxide reduction apparatus 20A according to the third embodiment of the present invention. Incidentally, among each configuration which the carbon dioxide reduction apparatus 20A of the present embodiment has, the members denoted by the same reference numerals as those of the carbon dioxide reduction apparatus 10A of the first embodiment have similar configurations to those of the carbon dioxide reduction apparatus 10A, unless otherwise described.

In the carbon dioxide reduction apparatus 20A, the inside of an electrochemical cell 21 is filled with an electrolyte solution 22, and the first electrode 11 and the second electrode 12 are arranged in the inside of the electrolyte solution 22. However, as long as the first electrode 11 and the second electrode 12 come in contact with the electrolyte solution 22, they do not necessarily need to be arranged in the inside of the electrolyte solution 22. In addition, in the carbon dioxide reduction apparatus 20A, a reference electrode (not shown) or the like may be provided which is arranged in the electrolyte solution 22 in a region in the side of the first electrode 11.

An ion conducting membrane 13 is arranged in the inside of the electrochemical cell 21, and the electrolyte solution 22 is partitioned into the region in the side of the first electrode 11 and a region in the side of the second electrode 12 by the ion conducting membrane 13, and the first electrochemical compartment 15 and the second electrochemical compartment 16 are formed. The electrolyte solution 22 in the second electrochemical compartment 16 is a solution which contains a reactant as has been described above. In addition, the electrolyte solution 22 in the first electrochemical compartment 15 may be the same as or different from the electrolyte solution 22 in the second electrochemical compartment 16.

In the carbon dioxide reduction apparatus 20A, one end of the first inlet port 17A is arranged in the inside of the electrolyte solution 22 in the first electrochemical compartment 15, and gaseous carbon dioxide is made to flow into the electrolyte solution by a method of bubbling or the like. At least a part of the carbon dioxide which has flowed therein dissolves in the electrolyte solution 22, and is brought in contact with the first electrode 11 to be reduced, and carbon monoxide is generated.

The carbon monoxide which has been generated on the first electrode 11 is sent to a space 23 above the electrolyte solution 22, then passes through a first connecting path 30, and is made to flow out to the second electrochemical compartment 16. At this time, unreacted carbon dioxide and the like may pass through the first connecting path 30 together with carbon monoxide, and be made to flow out to the second electrochemical compartment 16. The second electrochemical compartment 16 is filled with the reactant or the liquid mixture which is the electrolyte solution 22, and accordingly the second reaction proceeds similarly to each of the above described embodiments.

<Electrolyte Solution>

The electrolyte solution 22 is a solution in which anions and cations can migrate. The reactant or the liquid mixture to which the electrolyte salt is added is used for the electrolyte solution in the second electrochemical compartment 16. In addition, the same electrolyte as in the second electrochemical compartment 16 or a different electrolyte from the electrolyte may be used for the electrolyte solution in the first electrochemical compartment 15. Usable electrolytes in the first electrochemical compartment 15 include an aqueous solution of sodium hydrogen carbonate, an aqueous solution of sodium sulfate, an aqueous solution of potassium chloride, an aqueous solution of sodium chloride, and an aqueous solution of sodium hydroxide, in addition to the reactant or the liquid mixture to which the electrolyte salt is added.

Fourth Embodiment

Figure 4:
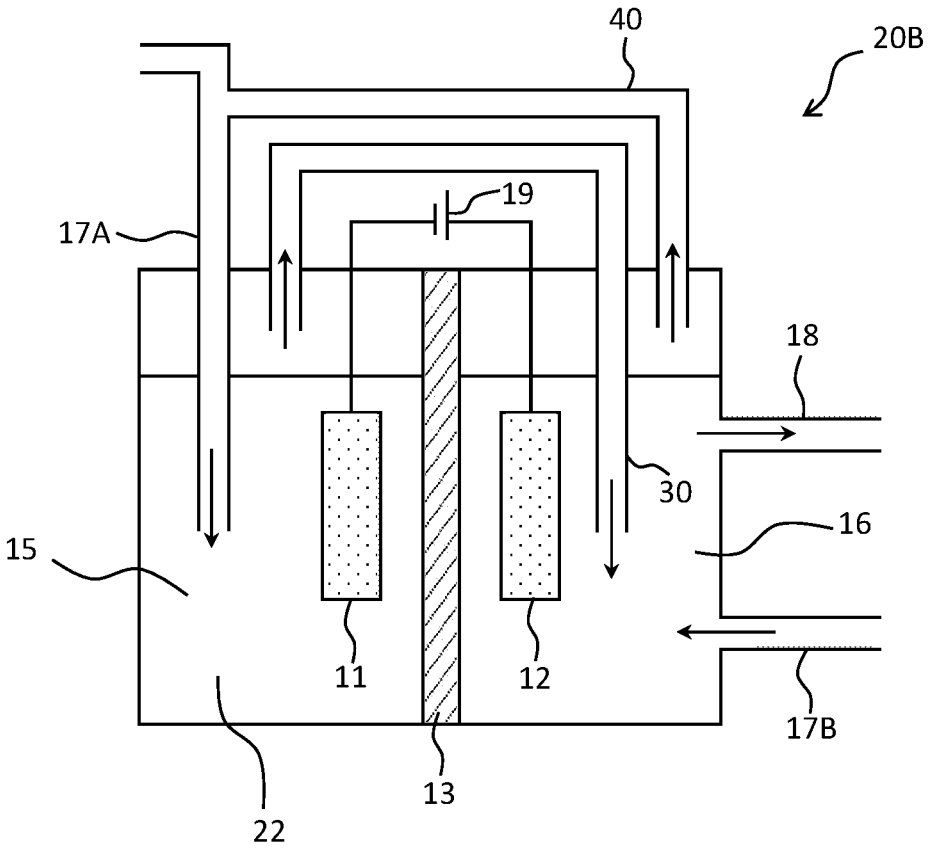
FIG. 4 is a schematic diagram showing another embodiment of the carbon dioxide reduction apparatus of the present invention.

A fourth embodiment is a carbon dioxide reduction apparatus in which the first electrochemical compartment 15 is filled with the electrolyte solution and a second connecting path is provided. FIG. 4 shows a schematic view of a carbon dioxide reduction apparatus 20B according to the fourth embodiment of the present invention.

Among each configuration which the carbon dioxide reduction apparatus 20B of the present embodiment has, the members denoted by the same reference numerals as those of the above described carbon dioxide reduction apparatus 20A of the third embodiment have similar configurations to those of the carbon dioxide reduction apparatus 20A. In addition, a configuration of the second connecting path 40 is as described in the carbon dioxide reduction apparatus 10B of the second embodiment.

Also in the present embodiment, similarly to the second embodiment, the carbon dioxide, the carbon monoxide and the like circulate in the carbon dioxide reduction apparatus 20B, and accordingly the configuration can enhance a conversion rate of the carbon dioxide in the whole carbon dioxide reduction apparatus and a generation rate of the final product.

Other Embodiments

Each carbon dioxide reduction apparatus shown in the above description shows one example of the carbon dioxide reduction apparatus of the present invention, and the carbon dioxide reduction apparatus of the present invention shall not be limited to the above described configurations.

For example, the carbon dioxide reduction apparatus may be a carbon dioxide reduction apparatus in which the voltage is applied by an electromotive force due to light.

In addition, a carbon dioxide reduction apparatus is also acceptable in which a reduced product of carbon dioxide other than carbon monoxide is allowed to flow into the second electrochemical compartment through the first connecting path, and such a reduced product is subjected to the second reaction. Furthermore, when the reduced product is a liquid or dissolves in a liquid, the reduced product may be allowed to pass through the first connecting path to flow into the second electrochemical compartment in the liquid state.

[Method of Producing Organic Compound]

A method of producing an organic compound of the present invention is a production method using the carbon dioxide reduction apparatus of the present invention, and the specific method is as described in the carbon dioxide reduction apparatus of the present invention.

The organic compound obtained by the production method of the present invention is a reaction product between the reduced product of carbon dioxide and the reactant. Specifically, the organic compounds include $(R^1O)_2CO$ in the above described formula (ii) and $(R^2NH)_2CO$ in the above described formula (iii), as has been described in the description of the carbon dioxide reduction apparatus of the present embodiment, but are not limited to these compounds.

As has been described above, the present invention can provide: a new carbon dioxide reduction apparatus which can effectively utilize electrical energy by combining a reaction occurring on the first electrode (cathode) with a reaction occurring on the second electrode (anode), in a carbon dioxide reduction apparatus; and a method of producing an organic compound using the carbon dioxide reduction apparatus.

EXAMPLES

The present invention will be described in more detail below with reference to the examples, but the present invention is not limited by these examples at all.

Example 1

A silver nanoparticle (manufactured by Sigma-Aldrich Inc.) in an amount of 30 mg and PTFE in an amount of 3 mg were dispersed in 0.3 mL of isopropanol, and then were applied onto a carbon paper. The resultant carbon paper was heated and dried at 80° C. for 1 hour, and a first electrode was obtained.

Next, 30 mg of $PdCl_2$ (manufactured by Sigma-Aldrich Inc.), 10 mg of mesoporous carbon (manufactured by Sigma-Aldrich Inc.) and 3 mg of PTFE were dispersed in 0.5 ml of isopropanol, and then were applied onto a carbon paper. The resultant carbon paper was heated at 300° C. for 1 hour, and a second electrode was obtained.

The obtained first electrode and second electrode were stacked on an ion conducting membrane formed of Nafion (trademark), the resultant stack was hot pressed at 59 MPa and 413 K, and a membrane-electrode assembly was prepared. The membrane-electrode assembly was set in the center of a two chamber type cell having spaces for the first electrochemical compartment and the second electrochemical compartment, so that a carbon dioxide reduction apparatus was prepared.

To the first electrochemical compartment, $CO_2$ (1 atm) was made to flow, and the second electrochemical compartment was filled with methanol (reactant) which contains 0.2 mol/L of LiBr (manufactured by Sigma-Aldrich Inc.) as an electrolyte salt. Furthermore, the first electrochemical compartment and the second electrochemical compartment were connected with each other by a Teflon tube, thereby a connecting path was formed, and the product formed in the first electrochemical compartment was bubbled in the second electrochemical compartment.

A voltage of 2.5 V was applied between the first electrode and the second electrode at 273 K, and the products in the first electrochemical compartment and the second electrochemical compartment were analyzed by gas chromatography (GC).

Example 2

A carbon dioxide reduction apparatus was prepared in a similar way to that in Example 1, except that the reactant was changed from methanol to ethanol, and the products were evaluated.

Example 3

A carbon dioxide reduction apparatus was prepared in a similar way to that in Example 1, except that a gold nanoparticle (manufactured by Sigma-Aldrich Inc.) was used in place of $PdCl_2$, and that the reactant in the second electrochemical compartment was changed from methanol to phenol, and the products were evaluated.

Example 4

A carbon dioxide reduction apparatus was prepared in a similar way to that in Example 1, except that the second electrochemical compartment was filled with acetonitrile which contained 0.002 mol/L of palladium acetylacetonate ($Pd(OAc)_2$) (manufactured by Sigma-Aldrich Inc.) as a third catalyst, 0.2 mol/L of tetrabutylammonium tetrafluoroborate (manufactured by Sigma-Aldrich Inc.) as the electrolyte salt, and 0.02 mol/L of butylamine ($BuNH_2$) (manufactured by Sigma-Aldrich Inc.) as the reactant, in place of methanol containing LiBr, and the products were evaluated.

Example 5

A carbon dioxide reduction apparatus was prepared in a similar way to that in Example 1 except that the second electrochemical compartment was filled with acetonitrile which contained 0.002 mol/L of palladium acetylacetonate ($Pd(OAc)_2$) (manufactured by Sigma-Aldrich Inc.) as a third catalyst, 0.2 mol/L of tetrabutylammonium tetrafluoroborate (manufactured by Sigma-Aldrich Inc.) as the electrolyte salt, and 0.02 mol/L of aniline ($PhNH_2$) (manufactured by Sigma-Aldrich Inc.) as the reactant, in place of methanol containing LiBr, and the products were evaluated.

Comparative Example 1

A carbon dioxide reduction apparatus was prepared in a similar way to that in Example 1, except that the second electrochemical compartment was filled with water which contained 0.2 mol/L of LiBr (manufactured by Sigma-Aldrich Inc.) as the electrolyte salt, in place of methanol containing LiBr, and that the connecting path which connects the first electrochemical compartment with the second electrochemical compartment was not provided, and the products were evaluated.

Comparative Example 2

A carbon dioxide reduction apparatus was prepared in a similar way to that in Example 1, except that the connecting path which connects the first electrochemical compartment with the second electrochemical compartment was not provided, and the products were evaluated.

Comparative Example 3

A carbon dioxide reduction apparatus was prepared in a similar way to that in Example 4, except that the connecting path which connects the first electrochemical compartment with the second electrochemical compartment was not provided, and the products were evaluated.

TABLE 1

| | Raw material | | Product | |
|---|---|---|---|---|
| | First electrochemical compartment | Second electrochemical compartment | First electrochemical compartment | Second electrochemical compartment |
| Example 1 | $CO_2$ | Methanol | CO | Dimethyl carbonate |
| Example 2 | $CO_2$ | Ethanol | CO | Diethyl carbonate |
| Example 3 | $CO_2$ | Phenol | CO | Diphenyl carbonate |
| Example 4 | $CO_2$ | Butylamine | CO | N,N'-Dibutylurea |
| Example 5 | $CO_2$ | Aniline | CO | N,N'-diphenyl urea |
| Comparative Example 1 | $CO_2$ | $H_2O$ | CO | $O_2$ |
| Comparative Example 2 | $CO_2$ | Methanol | CO | $CO_2$ |
| Comparative Example 3 | $CO_2$ | Butylamine | CO | None |

As shown in Table 1, in the first electrochemical compartment of each example, compounds were generated which could not be produced in the comparative examples. It is hereby clear that the carbon dioxide reduction apparatus of the present invention simultaneously utilizes a reduction reaction in the first electrode and an oxidation reaction in the second electrode, and thereby can convert carbon dioxide into a useful compound.

REFERENCE SIGNS LIST

10A, 10B, 20A and 20B Carbon dioxide reduction apparatus
11 First electrode
12 Second electrode
13 Ion conducting membrane
14 Membrane-electrode assembly
15 First electrochemical compartment
16 Second electrochemical compartment
17A First inlet port
17B Second inlet port
18 Discharge port
19 Power source
21 Electrochemical cell
22 Electrolyte solution
23 Space
30 First connecting path
40 Second connecting path

The invention claimed is:

1. A carbon dioxide reduction apparatus comprising:

a first electrochemical compartment provided with a first electrode;

a second electrochemical compartment provided with a second electrode;

an ion conducting membrane which demarcates the first electrochemical compartment from the second electrochemical compartment; and a first connecting path which connects the first electrochemical compartment with the second electrochemical compartment, the first electrode containing a first catalyst which catalyzes a reduction of carbon dioxide to carbon monoxide, the second electrode containing a second catalyst which catalyzes a reaction between the carbon monoxide and a reactant, the first connecting path being a connecting path which allows the carbon monoxide in the first electrochemical compartment to flow out to the second electrochemical compartment, wherein the reactant is contained in the second electrochemical compartment, and the reactant contains at least any one compound represented by the following general formulae (1) to (2):

$$R^1OH \quad (1)$$

wherein $R^1$ represents an organic group having 1 to 15 carbon atoms; and $$R^2NH_2 \quad (2)$$

wherein $R^2$ represents an organic group having 1 to 15 carbon atoms.

2. The carbon dioxide reduction apparatus according to claim 1 further comprising a second connecting path which connects the first electrochemical compartment with the second electrochemical compartment, wherein the second connecting path is a connecting path which allows carbon dioxide in the second electrochemical compartment to flow into the first electrochemical compartment.

3. The carbon dioxide reduction apparatus according to claim 1, wherein the second catalyst contains one or more elements of Groups 8 to 12.

4. The carbon dioxide reduction apparatus according to claim 1, wherein the second electrochemical compartment contains a third catalyst which catalyzes a reaction between the reduced product and the reactant.

5. The carbon dioxide reduction apparatus according to claim 4, wherein the third catalyst is a redox catalyst.

6. A method of producing an organic compound by using the carbon dioxide reduction apparatus according to claim 1.

7. The carbon dioxide reduction apparatus according to claim 1, wherein the reactant contains the compound represented by the general formula (1), wherein the organic group having 1 to 15 carbon atoms in $R^1$ is selected from the group consisting of a hydrocarbon group having 1 to 15 carbon atoms, a hydroxyalkyl group having 2 to 15 carbon atoms, and a group represented by the following formula (3), $$H—(OR)_m— \quad (3)$$

wherein, in the formula (3), R is a divalent saturated hydrocarbon group having 2 to 4 carbon atoms, and m is an integer of 2 to 7.

8. The carbon dioxide reduction apparatus according to claim 7, wherein the hydrocarbon group having 1 to 15 carbon atoms is selected from a group consisting of an alkyl group having 1 to 15 carbon atoms, an alkenyl group having 1 to 15 carbon atoms, and an aryl group having 6 to 15 carbon atoms.

9. The carbon dioxide reduction apparatus according to claim 1, wherein the reactant is an alcohol compound.

10. The carbon dioxide reduction apparatus according to claim 1, wherein the reactant is selected from the group consisting of methanol, ethanol, phenol, 1-propanol, 1-butanol, ethylene glycol, and propylene glycol.

11. The carbon dioxide reduction apparatus according to claim 1, wherein the second catalyst comprises a material selected from a group consisting of metal, metal compound, and electroconductive carbon material, wherein the metal or the metal in the metal compound is one or more elements of Groups 8 to 12.

12. The carbon dioxide reduction apparatus according to claim 11, wherein the second electrode comprises a composite material comprising a) at least one of the metal and the metal compound; and b) the electroconductive carbon material.

13. The carbon dioxide reduction apparatus according to claim 1, wherein the reactant or a liquid mixture of the reactant and solvent is contained in the second electrochemical compartment, wherein the reactant or the liquid mixture comprises an electrolyte salt, and wherein the electrolyte salt is selected from the group consisting of lithium chloride, lithium bromide, lithium iodide, sodium chloride, sodium bromide, sodium iodide, potassium chloride, potassium bromide, potassium iodide, ammonium chloride, ammonium bromide, and ammonium iodide.

14. The method of producing an organic compound according to claim 6, comprising:

making carbon dioxide flow into the first electrochemical compartment;

reducing the carbon dioxide flowing into the first electrochemical compartment on the first electrode so as to form carbon monoxide, the carbon monoxide flowing out from the first electrochemical compartment to the second electrochemical compartment through the first connecting path; and reacting the reactant in the second electrochemical compartment with the carbon monoxide on the second electrode to produce an organic compound.

* * * * *